US012114829B2

(12) United States Patent
Saur et al.

(10) Patent No.: US 12,114,829 B2
(45) **Date of Patent: *Oct. 15, 2024**

(54) SUCTION CONNECTION ADAPTER

(71) Applicant: Robert Bosch GmbH, Stuttgart (DE)

(72) Inventors: Dietmar Saur, Moessingen (DE); Tim Hartmann, Fellbach (DE)

(73) Assignee: Robert Bosch GmbH, Stuttgart (DE)

( * ) Notice: Subject to any disclaimer, the term of this patent is extended or adjusted under 35 U.S.C. 154(b) by 500 days.

This patent is subject to a terminal disclaimer.

(21) Appl. No.: 16/755,480

(22) PCT Filed: Sep. 12, 2018

(86) PCT No.: PCT/EP2018/074619

§ 371 (c)(1),
(2) Date: Apr. 10, 2020

(87) PCT Pub. No.: WO2019/081118

PCT Pub. Date: May 2, 2019

(65) Prior Publication Data

US 2021/0022572 A1 Jan. 28, 2021

(30) Foreign Application Priority Data

Oct. 23, 2017 (DE) ..... 10 2017 218 852.9

(51) Int. Cl.
*A47L 7/00* (2006.01)
*B24B 55/06* (2006.01)

(52) U.S. Cl.
CPC ..... *A47L 7/0095* (2013.01); *B24B 55/06* (2013.01)

(58) Field of Classification Search
CPC .... A47L 7/0095; A47L 9/0095; A47L 9/0045; A47L 9/248; A47L 9/2805; A47L 9/28;
(Continued)

(56) References Cited

U.S. PATENT DOCUMENTS 3,626,545 A * 12/1971 Sparrow ..... A47L 5/38 15/314
4,601,082 A * 7/1986 Kurz ..... A47L 9/2857 356/438

(Continued)

FOREIGN PATENT DOCUMENTS

CN 1486797 A 4/2004
CN 104097188 A 10/2014

(Continued)

OTHER PUBLICATIONS iVac Pro Switch Wireless Dust Collection Controller System Datasheet [online]. BCTINT Limited [retrieved on Dec. 7, 2021]. Retrieved from the Internet: <URL: http://go.rockler.com/tech/ivac-pro-switch-wireless-dust-collection-controller-system-manual.pdf>. (Year: 2021).*

(Continued)

*Primary Examiner* — Eric J Rosen
*Assistant Examiner* — Christopher Soto
(74) *Attorney, Agent, or Firm* — Maginot, Moore & Beck LLP

(57) ABSTRACT

A suction connection adapter for a suction device includes at least one machine connection unit and at least one suction device connection unit. The at least one machine connection unit is detachably connected to a machine tool, in particular a hand-held power tool. The at least one suction device connection unit is detachably connected to a suction hose of the suction device. The suction connection adapter has at least one sensor device.

14 Claims, 5 Drawing Sheets

(58) Field of Classification Search
CPC .... A47L 9/2842; A47L 9/2836; A47L 9/2857; A47L 9/2868; A47L 9/2894; B25F 5/00; B24B 55/06; H04W 76/10
USPC ..... 15/339, 319
See application file for complete search history.

(56) References Cited

U.S. PATENT DOCUMENTS

| | | | | |
|---|---|---|---|---|
| 6,044,519 | A * | 4/2000 | Hendrix | A47L 9/2805 15/319 |
| 7,296,323 | B2 * | 11/2007 | Hayama | A47L 7/0085 15/327.6 |
| 8,239,992 | B2 * | 8/2012 | Schnittman | A47L 11/34 15/52.1 |
| 8,584,310 | B2 * | 11/2013 | Beers | A47L 9/20 15/339 |
| 9,073,160 | B2 * | 7/2015 | Appel | B23Q 17/00 |
| 9,108,285 | B2 * | 8/2015 | Usselman | A47L 7/0095 |
| 9,409,273 | B2 * | 8/2016 | Brown | A47L 9/2805 |
| 9,723,959 | B2 * | 8/2017 | Suzuki | A47L 7/0095 |
| 10,893,784 | B2 * | 1/2021 | Majer | A47L 7/0095 |
| 2010/0199453 | A1 * | 8/2010 | Brotto | B23D 59/006 15/301 |
| 2016/0178398 | A1 | 6/2016 | Krapf et al. | |
| 2017/0347849 | A1 * | 12/2017 | Majer | A47L 9/248 |
| 2019/0207339 | A1 * | 7/2019 | Suzuki | H02M 1/082 |

FOREIGN PATENT DOCUMENTS

| | | | |
|---|---|---|---|
| DE | 10 2012 003 076 | A1 | 8/2013 |
| DE | 10 2012 003 077 | A1 | 8/2013 |
| DE | 10 2013 002 251 | A1 | 8/2013 |
| DE | 10 2012 216 884 | A1 | 3/2014 |
| DE | 10 2012 020 546 | A1 | 4/2014 |
| DE | 10 2014 005 222 | A1 | 10/2014 |
| DE | 20 2017 104 107 | U1 | 9/2017 |
| EP | 2 628 431 | A2 | 8/2013 |
| JP | 2001-179705 | A | 7/2001 |
| JP | 2002-326119 | A | 11/2002 |
| WO | 2012/031925 | A1 | 3/2012 |

OTHER PUBLICATIONS

International Search Report corresponding to PCT Application No. PCT/EP2018/074619, mailed Dec. 10, 2018 (German and English language document) (5 pages).

* cited by examiner

SUCTION CONNECTION ADAPTER

This application is a 35 U.S.C. § 371 National Stage Application of PCT/EP2018/074619, filed on Sep. 12, 2018, which claims the benefit of priority to Serial No. DE 10 2017 218 852.9, filed on Oct. 23, 2017 in Germany, the disclosures of which are incorporated herein by reference in their entirety.

The disclosure relates to a suction-extraction coupling adapter for a suction appliance, comprising at least one machine coupling unit, and comprising at least one suction-appliance coupling unit.

Background

There is already known from DE 10 2012 216 884 A1 a suction-extraction coupling adapter for a suction appliance, comprising at least one machine coupling element, and comprising at least one suction-appliance coupling element, the at least one machine coupling element being intended to be connected to a portable power tool, and the at least one suction-appliance coupling element being designed to be connectable to a dust extractor unit.

Summary

The disclosure is based on a suction-extraction coupling adapter for a suction appliance, comprising at least one machine coupling unit, and comprising at least one suction-appliance coupling unit. The at least one machine coupling unit is separably connectable to a power tool, in particular to a hand-held power tool. The at least one suction-appliance coupling unit is separably connectable to a suction hose of a suction appliance. It is proposed that the suction-extraction coupling adapter have at least one sensor device.

Owing to the at least one sensor device, the disclosure enables the suction-extraction coupling adapter to be used as a universal communication interface between the power tool and the suction appliance. Unlike the prior art, the disclosure achieves the object of establishing at least one communication between the power tool, in particular hand-held power tool, and the suction appliance. In the context of the disclosure, "universal" means that the suction-extraction coupling adapter according to the disclosure provides the at least one communication connection to the suction appliance independently of a power tool manufacturer. The suction-extraction coupling adapter according to the disclosure is thus compatible with, and can be used for, substantially any power tool, in particular hand-held power tool.

The suction-extraction coupling adapter according to the disclosure comprises a main tubular body, having at least one first and at least one second end region. The at least one machine coupling unit is arranged at the at least one first end region, and the at least one suction-appliance coupling unit is arranged at the at least second end region. The at least first end region is arranged substantially toward the power tool, whereas the second end region is arranged on an opposite side of the at least one first end region, in particular toward the suction appliance. The main tubular body is designed to extend a suction current, generated by the suction appliance, into a housing of the power tool, by means of the suction-extraction coupling adapter. This makes it possible for accruing particles, in particular dirt particles, to be extracted by suction directly from the power tool, in particular a hand-held power tool, when the power tool is in operation. The suction current transports the accruing particles, by means of the suction-extraction coupling adapter and the suction hose, into at least one dust collection device of the suction appliance. As an example, the suction-extraction coupling adapter may be realized as at least one suction-extraction nozzle.

The at least one machine coupling unit is arranged at the first end region of the suction-extraction coupling adapter and is designed to establish a separable connection to the power tool, in particular hand-held power tool.

For this purpose, the power tool, in particular a power tool housing, has at least one power-tool coupling unit. The at least one power-tool coupling unit is intended to receive the at least one machine coupling unit. In addition, the at least one power-tool coupling unit is designed to remove the accruing particles, in particular dirt particles, from a work surface, work region and/or work area of the user while the power tool is in operation. In particular, the at least one tool coupling unit may be integral with the power tool housing. The at least one machine coupling unit is configured to effect axial and radial securing to the power tool housing. For this purpose, the at least one machine coupling unit has at least one positive-locking element, for example in the form of a groove. The at least one power-tool coupling unit comprises at least one compatible positive-locking receiving element that receives the at least one positive-locking element, for example in the form of a spring.

The at least one suction-appliance coupling unit is arranged at the second end region of the suction-extraction coupling adapter, and is designed to realize a separable connection to the suction hose of the suction appliance. In particular, the at least one suction-appliance coupling unit serves to effect separable axial and/or radial securing of the suction hose. The suction appliance advantageously has at least one suction-appliance connection unit that has a main tubular body, such that the separable axial and/or radial securing can be effected. The suction-appliance coupling unit is preferably realized as a sleeve. The at least one suction-appliance coupling unit comprises at least one receiving unit, which is designed to establish a positive-locking and frictional connection to the at least one suction-appliance connection unit. For this purpose, the at least one suction-appliance connection unit has at least one securing unit. Particularly advantageously, the at least one receiving unit is shaped to correspond to the at least one securing unit, that it receives the at least one securing unit and thereby establishes the positive-locking and frictional connection. The axial and/or radial securing is therefore preferably provided in a frictional and positive-locking manner, although a frictional or positive-locking connection would also be conceivable. It is intended that a safe and reliable connection of the suction-extraction coupling adapter to the suction hose be established, and in particular ensured, by the positive-locking and frictional connection of the at least one suction-appliance coupling unit to the at least one suction-appliance connection unit.

According to the disclosure, the suction-extraction coupling adapter has at least one sensor device. The at least one sensor device has at least one sensor-device housing, and is arranged substantially on the suction-extraction coupling adapter. For example, the at least one sensor device is arranged on a region on the machine coupling side or on a region on the suction-appliance coupling side. In the context of the disclosure, "on the machine coupling side" means substantially partially in the first end region, and "on the suction-appliance coupling side" means substantially partially in the second end region. The at least one sensor device is advantageously mechanically connected to the suction-extraction coupling adapter. In the context of the disclosure, "mechanically connected" means that the connection is a frictional, positive-locking and/or materially bonded connection, which may be of a separable or inseparable design. In this design, the connection is mechanical, effected by fastening means, preferably screws. Alternatively, also conceivable is a clamping connection and/or a latching connection for the at least one sensor device on the suction-extraction coupling adapter, having the function of fastening the at least one sensor device to the suction-extraction coupling adapter. In another design of the disclosure, it is conceivable that the at least one sensor device can be separably attached to the suction-extraction coupling adapter by means of a plug-in connection and an associated plug-in device and/or a hook-and-loop connection. It is additionally conceivable for the at least one sensor device to be arranged in the suction-extraction coupling adapter, in particular incorporated in the suction-extraction coupling adapter. The term "incorporated" here is to be understood to mean integrated in the suction-extraction coupling adapter, such that the at least one sensor device is at least partially, in particular substantially entirely, enclosed by a material of the suction-extraction coupling adapter, the at least one sensor device and the suction-extraction coupling adapter then, in particular, forming a materially bonded connection. Further, it is possible for the at least one sensor device to be inside the suction-extraction coupling adapter, such that the suction current flows directly around the at least one sensor device.

Advantageously, the at least one sensor unit has at least one operator control unit. The at least one operator control unit comprises at least one operator control element and/or at least one indicating element. The at least one operator control unit of the at least one sensor device is configured to be operated by a user. Further, the at least one operator control unit of the at least one sensor device is designed to provide and indicate to the user at least one operating state and/or at least one operating parameter and/or at least one item of operating information of the at least one sensor device and/or of the suction appliance. It is also possible for the at least one operator control unit of the at least one sensor device to indicate the at least one operating state of the power tool, in particular hand-held power tool. In addition, the at least one operator control unit of the at least one sensor device may be designed to alter operating states and/or operating parameters of the at least one sensor device and/or of the suction appliance, in particular to control the at least one sensor device and/or the suction appliance by open-loop and/or closed-loop control. Preferably, the at least one operator control unit of the at least one sensor device is assigned to the at least one sensor-device housing, in particular arranged on the at least one sensor-device housing. Preferably, the at least one operator control unit of the at least one sensor device is arranged on at least one side of the sensor-device housing.

An operator control element, in particular of the at least one sensor device, may be realized as at least one press-on element, as at least one slide element, as at least one rotary element or, alternatively, as at least one tilt element. Other embodiments of the at least one operator control element are also conceivable. The at least one press-on element is designed to be pressed by an operator. The at least one slide element is designed to be slid by an operator. The at least one rotary element is designed to be turned by an operator. The at least one tilt element is designed to be tilted by an operator. Depending on the embodiment, a combination of the said operator control elements is also possible.

An indicating element, in particular of the at least one sensor device, is designed to indicate operating states and/or operating parameters and/or operating information. Examples of an indicating element are at least one LED or at least one display, or other indicating elements considered appropriate by persons skilled in the art. The operating states in this case may be, for example, "switched on", "switched off", "automatic operating mode" or "autostart". The operating parameters are, for example, at least one rotational speed, at least one power, in particular at least one suction power, at least one threshold value for at least one sensitivity of the at least one sensor device. Examples of the operating information are "pairing with an electrical appliance", "connected to an electrical appliance", "not connected to an electrical appliance", at least one battery charge state, of the at least one sensor device, of the suction appliance or of the power tool, in particular hand-held power tool. In addition, further examples of operating states, operating parameter and/or operating information, considered appropriate by persons skilled in the art, are also possible.

The at least one operator control unit of the at least one sensor device provides greater operating convenience for the user, and enables the latter to manipulate the sensor device in a simple and direct manner.

In a preferred design, the at least one sensor device has at least one sensor-device energy supply unit, which is designed to supply the at least one sensor device with energy. For this purpose, the at least one sensor-device energy supply unit is advantageously supplied with energy via at least one battery, in particular at least one button cell, via at least one accumulator-battery unit, or by means of energy harvesting. The design of the at least one sensor-device energy supply unit by means of the at least one battery, the at least one accumulator-battery unit or energy harvesting are is sufficiently known to persons skilled in the art, for which reason it is not discussed in greater detail here. It is also conceivable, in an alternative design, for the at least one sensor-device energy supply unit to be supplied with energy via a power line. In this case, it would be possible for the power line to be attached to the power tool or to the suction appliance.

The suction appliance, in a manner known per se, comprises, in particular, a suction-appliance drive, at least one suction-appliance energy supply unit, a dust collection device and a suction-appliance control unit. The details and action of the suction-appliance drive, dust collection device and suction-appliance control unit are sufficiently known to persons skilled in the art.

The suction appliance is preferably an accumulator-battery-operated suction appliance that can be operated by means of at least one accumulator battery, in particular by means of a hand-held power tool accumulator-battery pack. The provision of energy by the at least one suction-appliance energy supply unit is thus effected by means of the at least one accumulator battery. In the context of the disclosure, a hand-held power tool accumulator-battery pack is to be understood to mean a combination of at least one accumulator-battery cell and an accumulator-battery pack housing. The hand-held power tool accumulator-battery pack is advantageously designed for supplying energy to commercially available accumulator-battery-operated hand-held power tools. The at least one accumulator-battery cell may be realized, for example, as a Li-ion accumulator-battery cell having a nominal voltage of 3.6 V. For example, the hand-held power tool accumulator-battery pack comprises at least five accumulator-battery cells and has a total nominal operating voltage of 18 V, to enable the suction appliance to be operated with the correct power. Alternatively, the suction appliance may be a mains-operated suction appliance that can be connected to an external mains-power socket by means of an electric power supply cable. The external mains-power socket in this case may provide a voltage of, for example, 100 V, 110 V, 120 V, 127 V, 220 V, 230 V or 240 V, at 50 Hz or 60 Hz, but also a three-phase alternating voltage. The possible configurations of the external mains-power socket and the associated available voltages are well known to persons skilled in the art.

In addition, the suction appliance housing may have at least one suction-appliance operator control unit and at least one suction-appliance holding unit.

It is also conceivable for the suction appliance housing to comprise at least one suction appliance mains-power socket, such that a connected electrical appliance can be supplied with energy when the suction appliance itself is supplied with energy.

The suction-appliance operator control unit comprises at least one suction-appliance operator control element, which is designed to be operated by a user and to generate switching signals. The switching signals the control the suction-appliance drive via the suction-appliance control unit. The at least one suction-appliance operator control element may be arranged on a side of the suction appliance housing. Suction-appliance operator control elements may be, for example, a main switch or a setting switch. The main switch is provided for switching the suction-appliance drive on and off, or for changing over to the autostart function. The setting switch is designed to set a suction power of the suction appliance. The at least one suction-appliance operator control element is an operator control element of the suction appliance, in particular an operator control element of the type stated at the beginning. The suction hose is arranged, in particular, on the suction appliance housing.

The suction appliance housing comprises at least one mechanical interface, which substantially connects the suction hose to the suction appliance housing in a separable manner. This is effected by means of a frictional and/or positive-locking connection. Preferably, for this purpose the suction hose has at least one locking unit that, by means of the at least one mechanical interface, effects the frictional and/or positive locking connection of the suction hose to the suction appliance housing. The design of the at least one locking unit for a suction hose is sufficiently known by persons skilled in the art, for which reason it is not discussed in greater detail here.

The suction-appliance holding unit comprises at least one suction-appliance holding element, for example a suction-appliance handle, by which the user can hold the suction appliance. In addition, at least one suction-appliance movement unit may be attached to the suction appliance housing, such that, expediently, the suction appliance is a mobile suction appliance. The at least one suction-appliance movement unit is realized at least as a roller, at least as a wheel or the like, so that it can be moved on a base. Preferably, the mobile suction appliance is designed as a portable suction appliance, having rollers, wheels or the like, but also not having rollers, wheels or the like. In the context of the disclosure, the user can take along the suction appliance and use it directly at a desired place of use.

It is proposed that the at least one sensor device comprise at least one sensor unit, which is designed to sense at least one operating signal of the power tool, in particular of the hand-held power tool. The at least one sensor unit is arranged substantially in the sensor-device housing. Preferably, the at least one sensor unit is realized as at least one acceleration sensor that senses the at least one operating signal of the power tool, in particular its vibrations, during operation. Preferably, the at least one acceleration sensor senses substantially at least acceleration values of at least one spatial direction. Most preferably, the at least one acceleration sensor senses substantially at least acceleration values in at least three spatial directions. To enable the at least one sensor unit to sense the at least one operating signal, the at least one sensor unit is connected to the power tool by means of the suction-extraction coupling adapter.

It is also possible for the at least one sensor unit to be at least one rotational speed sensor, which senses at least one rotational speed of the power tool.

Further, it is also conceivable for the at least one sensor unit to be an acoustic sensor, in particular at least one microphone, that senses an operating sound of the power tool. The at least one operating sound is generated by the power tool as soon as the power tool is operated. In an alternative design, at least one magnetic field sensor is conceivable for the at least one sensor unit. The at least one magnetic field sensors detect(s) at least one magnetic field of the power tool as soon as the latter is operated. In addition, it is conceivable for the at least one sensor unit to be realized as at least one position sensor that senses at least one position of the power tool as soon as the suction-extraction coupling adapter has been connected to the power tool. Also possible, as the at least one sensor unit, is a movement sensor that senses at least one movement of the power tool when the latter has been connected to the power tool by means of the suction-extraction coupling adapter.

The at least one sensor unit enables the at least one sensor device to establish the universal communication interface, since the at least one sensor unit detects the at least one operating signal, irrespective of the type of power tool by which the at least one operating signal is generated. This increases the user-friendliness, and in particular the working speed of the user.

The power tool, in particular the hand-held power tool, generates the at least one operating signal while it is in operation. The at least one operating signal in this case may comprise the at least one vibration, caused by a rotation of a power tool motor and/or by work being performed on a workpiece. The at least one operating signal may also be at least one rotational speed, in particular at least a partial rotation, of the power tool, the at least one operating sound, in particular at least one acoustic sound, or the at least one magnetic field of the power tool during operation. Alternatively, the at least one operating signal may be the at least one position or the at least one movement of the power tool. Examples of power tools in this case are a circular table saw, a belt grinder, a table plane and other power tools considered appropriate by persons skilled in the art. Examples of hand-held power tools in this case are a sander, a screwdriver, in particular a cordless screwdriver or a mains-operated screwdriver, a rotary impact wrench, a drywall screwdriver, an impact drill, a hammer drill, a core drill, an angle grinder, an eccentric grinder, an orbital sander, a jigsaw, a demolition hammer, a hand-held circular saw, a hand-held plane or other hand-held power tools that are sufficiently known to persons skilled in the art.

Preferably, the at least one sensor device comprises at least one signal processing unit, which is designed to receive the at least one operating signal from the at least one sensor unit and process it into at least one communication signal. In this embodiment of the disclosure, the at least one signal processing unit is arranged substantially in the sensor-device housing. The at least one signalling processing unit processes the at least one operating signal into the at least one communication signal by means of, for example, at least one microprocessor and/or at least one microcontroller. The at least one communication signal comprises at least one operating state of the power tool, in particular of the hand-held power tool, such as, for example, switched on or switched off, or at least one filtered signal derived from the at least one operating signal. The at least one signal processing unit thus enables power tool information to be extracted by means of the at least one operating signal, and processed into the at least one communication signal. The at least one communication signal is substantially a data-reduced form of the at least one operating signal.

Advantageously, the at least one sensor device has at least one communication unit, which is designed to receive the at least one communication signal from the at least one signal processing unit, to provide at least one communication connection to a suction appliance, in particular to a suction-appliance communication unit, and to forward the at least one communication signal. The at least one signal processing unit is additionally designed to forward the at least one communication signal to the at least one communication unit. Also, the at least one communication unit is arranged substantially in the sensor-device housing. The at least one communication connection connects the at least one communication unit to the at least one suction-appliance communication unit, such that there is at least a one-way communication flow, and at least a two-way communication flow would also be possible. In the context of the disclosure, "one-way communication flow" means that the at least one communication signal is transmitted from the communication unit to the suction-appliance communication unit, and there is substantially no communication from the at least one suction-appliance communication unit to the communication unit. "Two-way communication flow" is to be understood to mean a bidirectional communication between the communication unit and the suction-appliance communication unit, such that at least one communication signal is transmitted from the communication unit to the suction-appliance communication unit, as well as at least one suction-appliance communication signal from the suction-appliance communication unit to the communication unit. The at least one suction-appliance communication signal in this case may comprise at least one operating signal of the suction appliance.

The suction appliance additionally comprises the at least one suction-appliance communication unit, the at least one suction-appliance communication unit being arranged substantially in the suction appliance housing. Preferably, the at least one suction-appliance communication unit is line-connected to the suction appliance controller. The at least one suction-appliance communication unit also transmits the at least one communication signal to the suction-appliance control unit. The at least one suction-appliance communication unit is at least one communication unit of the suction appliance, i.e. a communication unit.

In the context of the disclosure, the at least one communication unit is designed to send and/or receive communication signals. The communication signals may be transmitted by line connection, via a wire connection or, alternatively, via printed conductors on a printed circuit board, and/or the communication signals may be transmitted wirelessly. A wireless transmission of the communication signals in this case may be in the form of Bluetooth, WLAN, infrared, near-field communication (NFC) by means of RFID technology, as well as other wireless transmissions of the communication signals familiar to persons skilled in the art. Communication protocols used in this case may be Bluetooth Smart, GSM, UMTS, LTE, ANT, ZigBee, LoRa, SigFox, NB-IoT, BLE, IrDA, as well as other communication protocols familiar to persons skilled in the art.

The at least one communication unit thus makes it possible to provide the universal communication interface, and to establish an indirect connection of the power tool and suction appliance. In particular, the at least one communication unit enables the power tool to communicate with the suction appliance via the at least one sensor device, irrespective of what type of power tool is connected to the suction-extraction coupling adapter. This enhances user-friendliness and, in particular, increases the efficiency of the user's work processes.

Preferably, the at least one communication connection is realized as a wireless communication connection. The at least one communication unit transmits the at least one communication signal wirelessly, via the at least one communication connection, to the at least one suction-appliance communication unit. The wireless communication connection reduces the susceptibility of the at least one communication connection to physical interference and increases the reliability of the at least one communication connection.

To enable the at least one communication unit and the suction-appliance communication unit to establish the wireless communication connection, the two communication units must perform a coupling, or pairing, process. In the context of this disclosure, the coupling process, also called "pairing", means that two communication units establish a wireless connection with each other, register, or recognize, each other, and subsequently communicate with each other. In this case, the pairing may be, for example, via a first or a second communication path. In the case of the first communication path, the pairing is effected via a Bluetooth connection, with further communication likewise being effected via the Bluetooth connection after coupling has been successfully completed. In the case of the second communication path, pairing is effected via near-field communication (NFC), in which the suction-extraction coupling adapter, in particular the at least one communication unit, and the suction appliance, in particular the suction-appliance communication unit, are brought directly into range of each other. This causes the suction-extraction coupling adapter and the suction device to couple, with subsequent communication then being effected via a Bluetooth connection. Persons skilled in the art are sufficiently familiar with the sequence of the coupling process, as well as the pairing, and also the pairing, via the first or second communication path, between two communication units, for which reason these are not discussed in greater detail here.

The at least one sensor device thus comprises the at least one sensor unit, the at least one signal processing unit, the at least one communication unit and the at least one sensor-device energy supply unit. These elements may preferably be arranged within a sensor-device housing or, alternatively, within a plurality of sensor-device housings. Further, these elements may advantageously be arranged on at least one printed circuit board, such that they can be connected to each other by means of printed conductors; it is also conceivable for these elements to be wire-connected to each other if they are not arranged on the at least one printed circuit board. Preferably, the at least one sensor unit is line-connected to the at least one signal processing unit, in particular arranged on at least the same printed circuit board, such that the at least one operating signal is transmitted directly and immediately from the at least one sensor unit to the at least one signal processing unit. As described at the beginning, the at least one signal processing unit processes the at least one operating signal into the at least one communication signal. The at least one communication signal is then preferably forwarded by means of printed conductors from the at least one signal processing unit to the at least one communication unit, since preferably the at least one communication unit is arranged on the same printed circuit board as the at least one signal processing unit. Alternatively, the at least one signal processing unit and the at least one communication unit are wire-bound. In an alternative embodiment, it is conceivable for the elements of the at least one sensor device also to be wirelessly connected to be each other.

In a first embodiment of the disclosure, the at least one signal processing unit is additionally designed to convert the at least one operating signal into at least one evaluation signal by means of at least one evaluation unit. The at least one evaluation unit is designed to forward the at least one evaluation signal as the at least one communication signal. The at least one signal processing unit comprises the at least one evaluation unit, the at least one evaluation unit being arranged substantially in the signal processing unit.

The at least one sensor unit transmits the at least one operating signal directly and immediately to the at least one signal processing unit. The at least one operating signal is then processed within the signal processing unit, in particular in the at least one evaluation unit, for example by means of a microprocessor and/or microcontroller. In at least one evaluation step, the at least one operating signal is filtered, at least substantially, for example by means of at least one bandpass filter. Here, possible disturbance variables that may be at least partially present in the at least one operating signal are substantially filtered in order to enable further evaluation. Possible disturbance variables that may affect the quality of the at least one operating signal are, for example, influences from the user's work environment, influences caused by the user, influences caused by the suction appliance, or other disturbance variables, considered appropriate by persons skilled in the art, that affect the quality of the at least one operating signal. In particular, disturbance variables are substantially movements that result in an acceleration value and that are generated by the operation of the connected power tool, such as, for example, movements of the power tool and/or the suction appliance, vibrations and/or transporting of the power tool and/or suction appliance.

If negative signal values are contained in the at least one operating signal, the magnitude of the at least one operating signal is determined in an at least second evaluation step, such that the at least one operating signal substantially comprises positive signal values. Then, in an at least third evaluation step, the at least one operating signal is at least partially smoothed. The smoothing of the at least one operating signal in the at least third evaluation step is performed by means of the moving average method. Afterwards, the at least one operating signal is processed into the at least one evaluation signal, in an at least fourth evaluation step, by means of an algorithm such as, for example, a Schmitt trigger. This enables the at least one operating signal to be converted into the at least one evaluation signal. The at least one evaluation signal is then forwarded, as the at least one communication signal, to the at least one communication unit. The at least one evaluation signal comprises, at least substantially, information concerning the at least one operating state and/or the at least one operating parameter of the power tool, in particular the hand-held power tool, in a data-reduced form. In particular, the at least one evaluation signal comprises the information concerning the power tool "switched on" or "switched off". The at least one evaluation signal is thus at least one evaluated operating signal.

This allows rapid and efficient signal processing, and increases the working speed. In an alternative embodiment, it is conceivable to perform a different sequence of evaluation steps in order to proceed from the at least one operating signal to the at least one evaluation signal.

In a second embodiment, the at least one signal processing unit is additionally realized to convert the at least one operating signal into at least one filter signal by means of at least one filter unit. The at least one filter unit is designed to forward the at least one filter signal as the at least one communication signal. The at least one signal processing unit additionally comprises the at least one filter unit. Preferably, the at least one filter unit is arranged substantially in the signal processing unit.

In the second embodiment, also, the at least one sensor unit forwards the at least one operating signal directly and immediately to the at least one signal processing unit. The at least one operating signal is then processed by the signal processing unit, in particular the at least one filter unit, for example by means of a microprocessor and/or microcontroller. After the at least one filter unit has received the at least one operating signal, in an at least first filter step the at least one operating signal is filtered, at least substantially, for example by means of at least one bandpass filter. Also here, in the second embodiment, possible disturbance variables that may be at least partially present in the at least one operating signal are substantially filtered. Possible disturbance variables are as described at the beginning. In the case of negative signal values of the at least one operating signal, the magnitude of the at least one operating signal is determined in an at least second filter step. As a result, the at least one operating signal has substantially positive signal values. Then, in an at least third filter step, the at least one operating signal is at least partially smoothed. In the second embodiment, also, the smoothing of the at least one operating signal is performed, in the at least third filter step, by means of the moving average method. Following the at least third filter step, the at least one operating signal is converted into the at least one filter signal. The at least one filter unit then forwards the at least one filter signal, as the at least one communication signal, to the at least one communication unit. The at least one filter signal thus comprises, at least substantially, data-reduced information concerning the at least one operating state and/or the at least one operating parameter of the power tool, in particular of the hand-held power tool. The at least one filter signal is thus at least one pre-filtered operating signal. The filter steps described serve substantially to process the at least one operating signal, sensed by means of the at least one sensor unit, into a stable and unambiguous signal.

A simple and compact sensor device is thus provided. Alternatively, it would be possible to perform a different sequence of filter steps in order to proceed from the at least one operating signal to the at least one filter signal.

In both embodiments, the at least one operating signal is an analog signal, such that the at least one operating signal is generated in an analog form by the power tool, in particular the hand-held power tool. The at least one sensor device is configured to sense the at least one operating signal, in particular the analog signal, and to process it into the at least one communication signal. In this case, substantially no conversion of the at least one, analog, operating signal is effected, such that the at least one communication signal is substantially still an analog signal. The at least one sensor device then transmits the at least one, analog, communication signal to the suction appliance, in the analog form. It is conceivable for the at least one, analog, operating signal to be substantially converted into a digital signal. The conversion of the at least one, analog, operating signal into a digital signal may substantially be performed by the at least one sensor device or by the suction appliance. For this purpose, the at least one sensor device may additionally comprise at least one analog/digital converter unit (ND converter unit). The at least one ND converter unit converts the analog signal into the digital signal by means of a suitable evaluation algorithm. The functioning and structure of the at least one A/D converter unit is sufficiently well known to persons skilled in the art, for which reason these are not discussed in greater detail here.

The a least one A/D converter unit in this case is arranged substantially within the sensor-device housing. Preferably, the at least one A/D converter unit is realized as a separate element of the at least one sensor device. It is also conceivable, however, for the at least one ND converter unit to be comprised by the at least one sensor unit, the at least one signal processing unit, the at least one evaluation unit, the at least one filter unit and/or the at least one communication unit. It is thus possible for the at least one operating signal to be converted into a digital signal, such that the elements of the at least one sensor device substantially process the at least one, digital, operating signal. The at least one, digital, operating signal is thus then processed into the at least one communication signal, in digital form. In particular, substantially the at least one evaluation signal or the at least one filter signal is then present in digital form. The suction appliance then processes the at least one, digital, communication signal.

Alternatively, it is also conceivable for the suction appliance to comprise the at least one A/D converter unit. In particular, it is possible for the at least one A/D converter unit to be arranged as a substantially separate element within the suction appliance housing, or to be comprised, at least partially, by the at least one suction-appliance communication unit and/or the suction-appliance control unit. The at least one operating signal is thus converted into the at least one communication signal, in analog form, by the at least one sensor device, and then transmitted to the suction appliance. The suction appliance then subsequently converts the at least one, analog, communication signal into the at least one communication signal in digital form, and evaluates this signal.

The at least one sensor device thus provides the suction appliance with an autostart function for substantially all power tools, in particular hand-held power tools. The autostart function in the case of mains-operated suction appliances having the suction-appliance mains socket on the suction appliance housing is sufficiently known from the prior art. In the case of mains-operated suction appliances, a mains-operated electric power tool can be connected to the mains socket of the suction appliance. The autostart function enables the mains-operated suction appliance to start automatically as soon as a load-dependent current is present at the mains socket. This load-dependent current is present as soon as the mains-operated electric power tool is operated. Persons skilled in the art are sufficiently familiar with the functioning of the autostart function in the case of mains-operated suction appliances having the suction-appliance mains socket, in particular in use of the mains-operated electric power tool, for which reason it is not discussed in greater detail here.

The suction-extraction coupling adapter according to the disclosure, having the at least one sensor device, thus provides the suction appliance with the autostart function irrespective of whether it has a suction-appliance mains socket, and irrespective of the type of energy supply of the power tool. In order to activate the autostart function, the user sets the suction-appliance operator control element, on the suction-appliance operator control unit, and/or the at least one operator control element, on the at least one operator control unit of the at least one sensor device, to an autostart function position. In the autostart function position, the at least one sensor unit is activated, such that it senses the at least one operating signal. Activation of the at least one sensor device is effected substantially only when the autostart function position is set by the user. Alternatively, in the autostart function position the suction appliance activates the power supply for the at least one sensor device, such that the at least one sensor device is supplied with power only in the autostart function position. As soon as the at least one sensor unit registers the at least one operating signal, a sequence of the steps as described above is performed. In particular, the at least one operating signal is processed by means of the at least one sensor device into the at least one communication signal and transmitted, via the wireless communication connection, to the suction appliance, in particular to the suction-appliance communication unit. The suction-appliance communication unit then transmits the at least one communication signal to the suction-appliance control unit, which then controls the suction-appliance drive by open-loop and/or closed-loop control.

As soon as the power tool, in particular the hand-held power tool, is no longer being used by the user, and the power tool substantially is not generating an operating signal, the at least one sensor unit registers the at least one, changed, operating signal. The suction appliance is thereupon switched off by the absence of the at least one operating signal. It is conceivable for the suction drive substantially to have an after-run, such that, in the absence of at least one operating signal, the suction extraction by the suction appliance is present for a certain period of time. When the autostart function is activated, substantially the at least one sensor device is permanently activated, such that the sensor unit substantially permanently monitors a change in the at least one operating signal. This enables a rapid and substantially immediate reaction of the at least one sensor device.

The suction appliance may be directly controlled, by open-loop and/or closed-loop control, by the substantially permanent activation of the at least one sensor device, in particular the at least one sensor unit. Moreover, it would also be possible for the at least one sensor device to switch to an idle mode as soon as the autostart function has been activated. The at least one sensor device is designed to wake up from the idle mode as soon as the at least one sensor device, in particular the at least one sensor unit, senses a change in the at least one operating signal. In addition, the user may set at least one trigger threshold value, via the at least one operator control unit of the at least one sensor device, for activation of the autostart function. The at least one trigger threshold value in this case is dependent on a signal strength of the at least one operating signal. The autostart function is then substantially triggered only when a particular signal strength of the at least one operating signal is attained and/or exceeded. This enables the user to trigger the autostart function according to the power tool, in particular hand-held power tool, used. The autostart function is thus rendered possible for substantially all power tools, in particular hand-held power tools.

Advantageously, the at least one sensor device is designed to control a suction appliance by open-loop and/or closed-loop control, in particular to change an operating mode of a suction appliance, when the at least one sensor device registers at least one predefined signal. The suction appliance comprises substantially the operating modes "switched off", "switched on" and "autostart". Preferably, the suction appliance changes the operating mode from "switched on" to "autostart" as soon as the at least one sensor device registers the at least one predefined signal, with a change from "autostart" to "switched on" also being possible. The at least one predefined signal is triggered and/or generated substantially by the user. Preferably, the at least one predefined signal is tapping by the user on the at least one sensor device. Other predefined signals, considered appropriate by persons skilled in the art, are also conceivable. An increased work rate and flexible adaptation of the operating mode of the suction appliance to the user's requirements are thus made possible.

The disclosure is also based on a system comprising a suction-extraction coupling adapter, as described at the beginning, and a suction appliance, as explained above. Particularly preferably, the system additionally comprises a power tool, in particular a hand-held power tool.

BRIEF DESCRIPTION OF THE DRAWINGS

The disclosure is explained in the following on the basis of preferred embodiments. The following drawings show.

DETAILED DESCRIPTION

Figure 1:
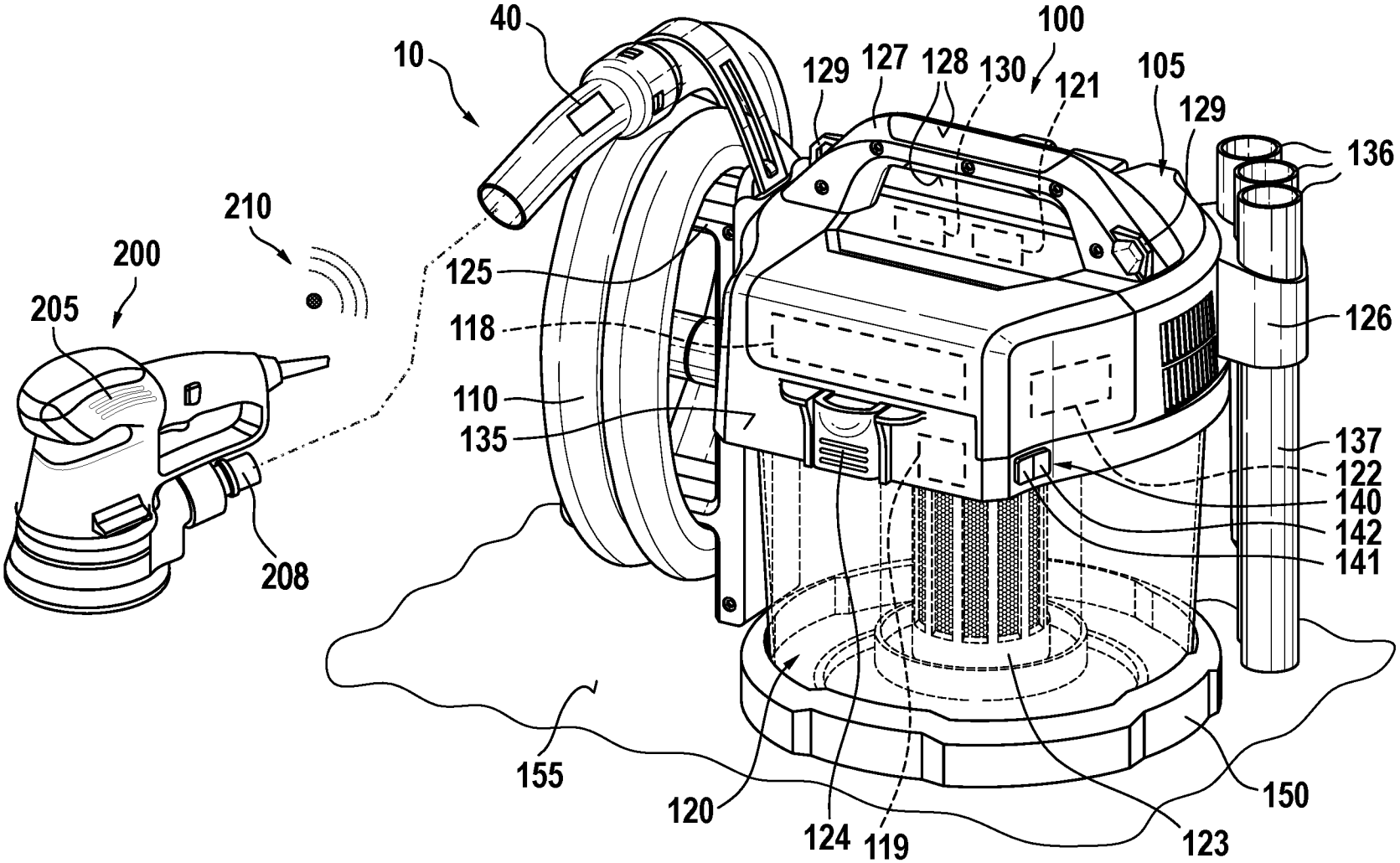
FIG. 1 a suction-extraction coupling adapter according to the disclosure with a power tool and a suction appliance, in a schematic view.

FIG. 1 shows a suction appliance 100, comprising a suction appliance housing 105, comprising a suction hose 110, and comprising a suction-appliance communication unit 130, in a schematic view. Also represented in FIG. 1 are a suction-extraction coupling adapter 10 according to the invention, comprising a sensor device 40, and a power tool 200, which in this case, by way of example, is realized as a sander. The power tool 200 comprises a power tool housing 205 and a power-tool coupling unit 208, see also FIG. 2. The sensor device 40 is arranged on, in particular attached to, the suction-extraction coupling adapter 10. In this design of the invention, the suction hose 110 can be separably attached to the suction appliance housing 105. In this embodiment, the suction-appliance communication unit 130 is arranged substantially in the suction appliance housing 105. The suction appliance 100 additionally has a sensor device 70. The suction appliance 100 has a suction-appliance drive 119, a suction-appliance energy supply unit 118, a dust collection device 120 and a dust-collection filter element 123. The suction appliance housing 105 in this case comprises the dust collection device 120, and they are separably connectable to each other by means of at least one locking element 124. The functioning and combined action of the suction-appliance drive 119, suction-appliance energy supply unit 118 and dust collection device 120 are sufficiently well known by persons skilled in the art. The suction appliance additionally comprises a suction-appliance control unit 121, which is designed to control the suction appliance 100 by open-loop and/or closed-loop control. In addition, the suction appliance housing 105 is separably connected to a first accessory carrier 125 and a second accessory carrier 126. A suction-appliance holding means 127 has a suction-appliance grip region 128 and is arranged on the suction appliance housing 105, in particular on one side of the suction appliance housing 105, specifically on a top side of the suction appliance housing 105. The suction-appliance grip region 128 is designed, in particular, to be encompassed by a hand of the user of the suction appliance 100. The suction-appliance holding means 127 advantageously enables the suction appliance 100 to be carried when in use or when being transported. The suction-appliance holding means 127 additionally has two fastening elements 129. In this embodiment, the fastening elements 129 are realized as eyes. The fastening elements 129 serve as a fastening means, for example for a shoulder strap having two spring clips. The suction-appliance holding means 127 is connected to the housing 105 so as to be immovable relative to the housing 105. It is also conceivable for the suction-appliance holding means 127 to be mounted so as to be movable relative to the housing 105, for example foldable. The suction appliance housing 105 has a suction-appliance operator control unit 140, the suction-appliance operator control unit 140 comprising a suction-appliance operator control element 141 and a suction-appliance indicating element 142. The suction-appliance operator control unit 140 is designed to be operated by a user. By means of the suction-appliance operator control element 141, the user can switch on and switch off the suction appliance 100, or activate an autostart function. The suction-appliance indicating element 142 in this case indicates a set operating mode of the suction appliance 100 to the user. The suction-appliance indicating element 142 can be switched on and/or off by means of the suction-appliance operator control element 141. The dust collection device 120 is substantially cylindrical, in particular substantially realized as a truncated cone. The dust collection device 120 comprises a stand element 150, which is designed to increase the stability of the suction appliance 100. The stand element 150 increases a diameter of the contact surface of the suction appliance 100. In particular, the points of contact of the suction appliance 100 with a standing surface 155 are increased. Further, the stand element 150 is configured to enhance the ergonomics of the suction appliance 100. Advantageously, the stand element 150 comprises at least one grip region, which may be realized, for example, as a recess. Advantageously, the stand element 150 is designed to absorb impacts and, in particular, for this purpose it is made of an elastic material. Further, it is possible for a suction-appliance movement unit, for example comprising rollers, to be arranged on the stand element 150. In an alternative embodiment, it is conceivable for the stand element 150 to have a substantially rectangular cross section that fits, in particular is compatible with, existing transport containers, in particular dust collection devices.

The separable connection of the suction appliance housing 105 to the dust collection device 120 is effected via the at least one locking element 124. In this embodiment, the at least one locking element 124 is arranged on an outer side 135 of the suction appliance housing. The at least one locking element 124 is arranged in a movable manner on the suction appliance housing 105, in particular connected to it. In addition, the at least one locking element 124 effects a frictional and positive-locking connection between the suction appliance housing 105 and the dust collection device 120. In this embodiment, the suction appliance housing 105 comprises two locking elements 124, arranged opposite each other on the outer side 135 of the suction appliance housing 105.

Advantageously, the first accessory carrier 125 is designed to support the suction hose 110. In particular, the first accessory carrier 125 is designed to support the suction hose 110 in a secure manner, such that the suction hose 110 does not impede the user when the suction appliance 100 is being transported. In this embodiment, the second accessory carrier 126 comprises three receiving openings, which are designed to receive at least three accessory elements 136. The accessory elements 136 may be designed such that they can be plugged into each other, such that more than three accessory elements 136 can be received by the second accessory carrier 126. Preferably, tubular elements 137 that can be connected to each other can be received by the accessory carrier 126.

In this embodiment, the suction appliance 100 is realized as an accumulator-battery-operated suction appliance that is operated by means of at least one accumulator battery 122, in particular by means of a hand-held power-tool accumulator-battery pack. The required energy for the suction appliance 100 is thus provided by the at least one suction-appliance energy supply unit 118, by means of the at least one accumulator battery 122. In addition, the suction-appliance indicating element 142 is realized as a charge-state indicator. The charge-state indicator is designed to indicate the charge state of the accumulator battery 122. Advantageously, the charge state of the accumulator battery 122 can be indicated, via the suction-appliance indicating element 142, while the suction appliance 100 is in operation. In addition, it is conceivable for the suction-appliance indicating element 142 to indicate further information relating to the accumulator battery 122 of the suction appliance 100, or also relating to the fill level of the dust collection device 120.

Figure 2:
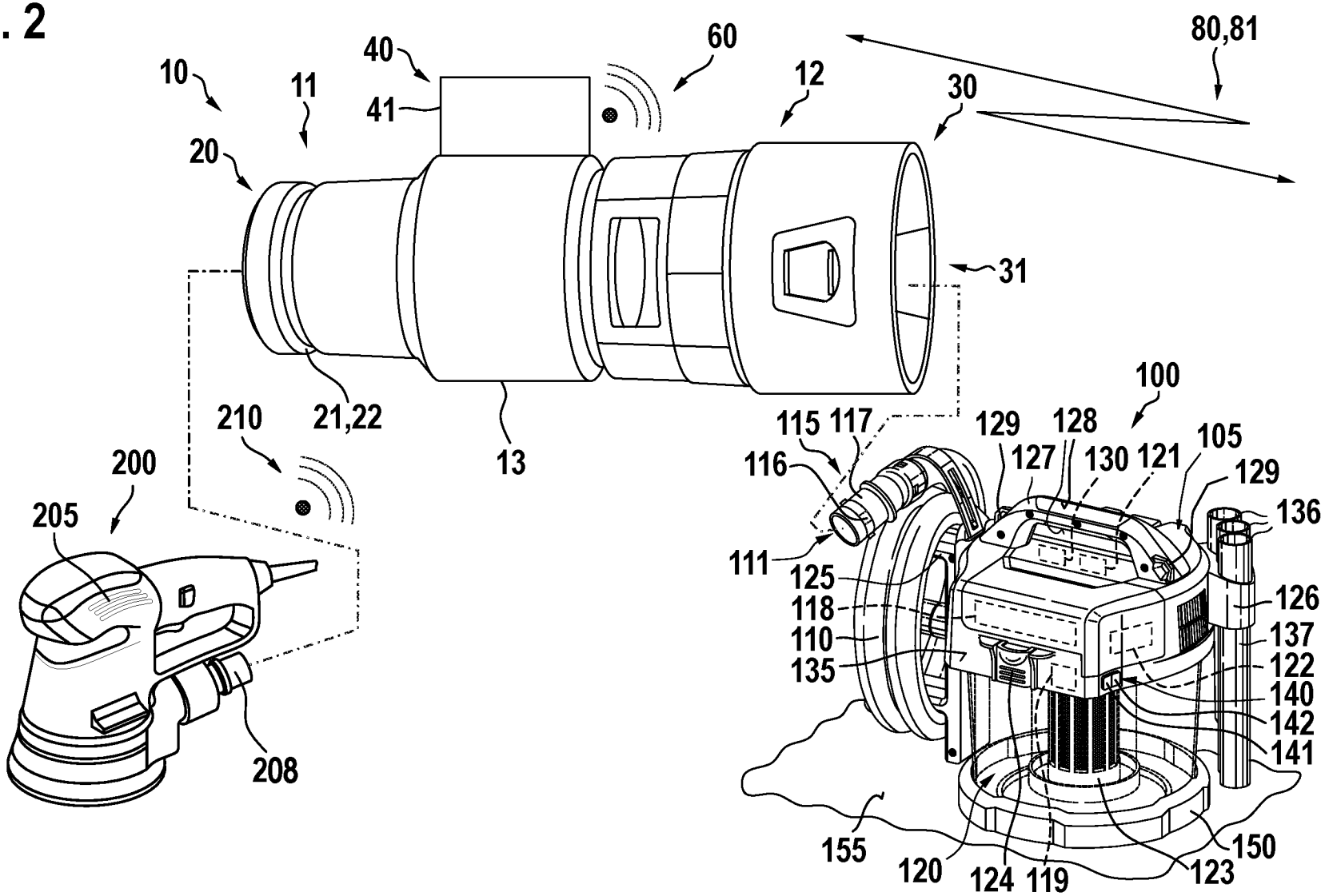
FIG. 2 the suction-extraction coupling adapter according to the disclosure with a sensor device and a suction hose.

The suction hose 110 comprises a suction opening 111, and can be separably attached to the suction appliance housing 105, see also FIG. 2. The suction opening 111 is configured to receive accruing particles, in particular dust particles, while the suction appliance 100 is in operation and to transport them, by means of the suction hose 110, to the dust collection device 120. The suction hose 110 is separably connectable to the power tool 200, in particular the hand-held power tool, by means of the suction-extraction coupling adapter 10.

FIG. 2 shows the suction-extraction coupling adapter 10 according to the disclosure in an enlarged schematic representation. The suction-extraction coupling adapter 10 according to the disclosure has a main tubular body 13, having a first and at least one second end region 11, 12. A machine coupling unit 20 is arranged at the first end region 11. A suction-appliance coupling unit 30 is arranged at the second end region 12. As shown in FIG. 2, the first end region 11 faces substantially toward the power tool 200. The second end region 12 is located on an opposite side of the first end region 11, in particular facing toward the suction appliance 100. The main tubular body 13 is configured to extend a suction current, generated by the suction appliance 100, into a housing 205 of the power tool 200, by means of the suction-extraction coupling adapter 10.

The machine coupling unit 20 realizes a separable connection to the power tool 200, in particular the hand-held power tool. For this purpose, the power tool 200, in particular the power tool housing 205, comprises a power-tool coupling unit 208. The power-tool coupling unit 210 208 is configured to receive the machine coupling unit 20. The machine coupling unit 20 effects axial and radial securing to the power tool housing 205. For this purpose, the machine coupling unit 20 comprises a positive-locking element 21, for example in the form of a groove 22. The power-tool coupling unit 205 has a compatible positive-locking receiving element, which is configured to receive the positive-locking element 21, for example in the form of a spring.

The suction-appliance coupling unit 30 is arranged at the second end region 12 of the suction-extraction coupling adapter 10, and effects a separable connection to the suction hose 110 of the suction appliance 100. The suction-appliance coupling unit 30 is designed to effect axial and/or radial securing of the suction hose 100. The suction appliance 100 comprises a suction-appliance connection unit 115 that has a main tubular body 117, such that the separable axial/and/or radial securing can be effected. The suction-appliance coupling unit 30 is realized, for example, as a sleeve. The suction-appliance coupling unit 30 has a receiving unit 31, which is configured to realize a positive-locking and frictional connection to the suction-appliance connection unit 115. For this purpose, the suction-appliance connection unit 115 comprises a securing unit 116. In this embodiment, the receiving unit 31 is realized so as to correspond to the securing unit 116, such that the receiving unit 31 can receive the securing unit 116, and the positive-locking and frictional connection can be effected.

The suction-extraction coupling adapter 10 comprises the sensor device 40. The sensor device 40 comprises a sensor-device housing 41, and is arranged on, in particular attached to, the suction-extraction coupling adapter 10. In this embodiment, the sensor device 40 is arranged on a region on the machine coupling side, in particular on the first end region 11. Alternatively, it would also be possible for the sensor device 40 to be arranged on a region on the suction-appliance coupling side, in particular in the second end region 12. The sensor device 40 is mechanically coupled to the suction-extraction coupling adapter 10.

The sensor device 40 is designed to sense the operating signal 210 of the power tool 200, in particular of a hand-held power tool, see also FIG. 1. The sensor device 40 then processes the operating signal 210 into a communication signal 60 and transmits it, by means of a communication connection 80, to the suction appliance 100, in particular to the suction-appliance communication unit 130, see also FIG. 3. In this design, the communication connection 80 is realized as a wireless communication connection 81.

Figure 3:
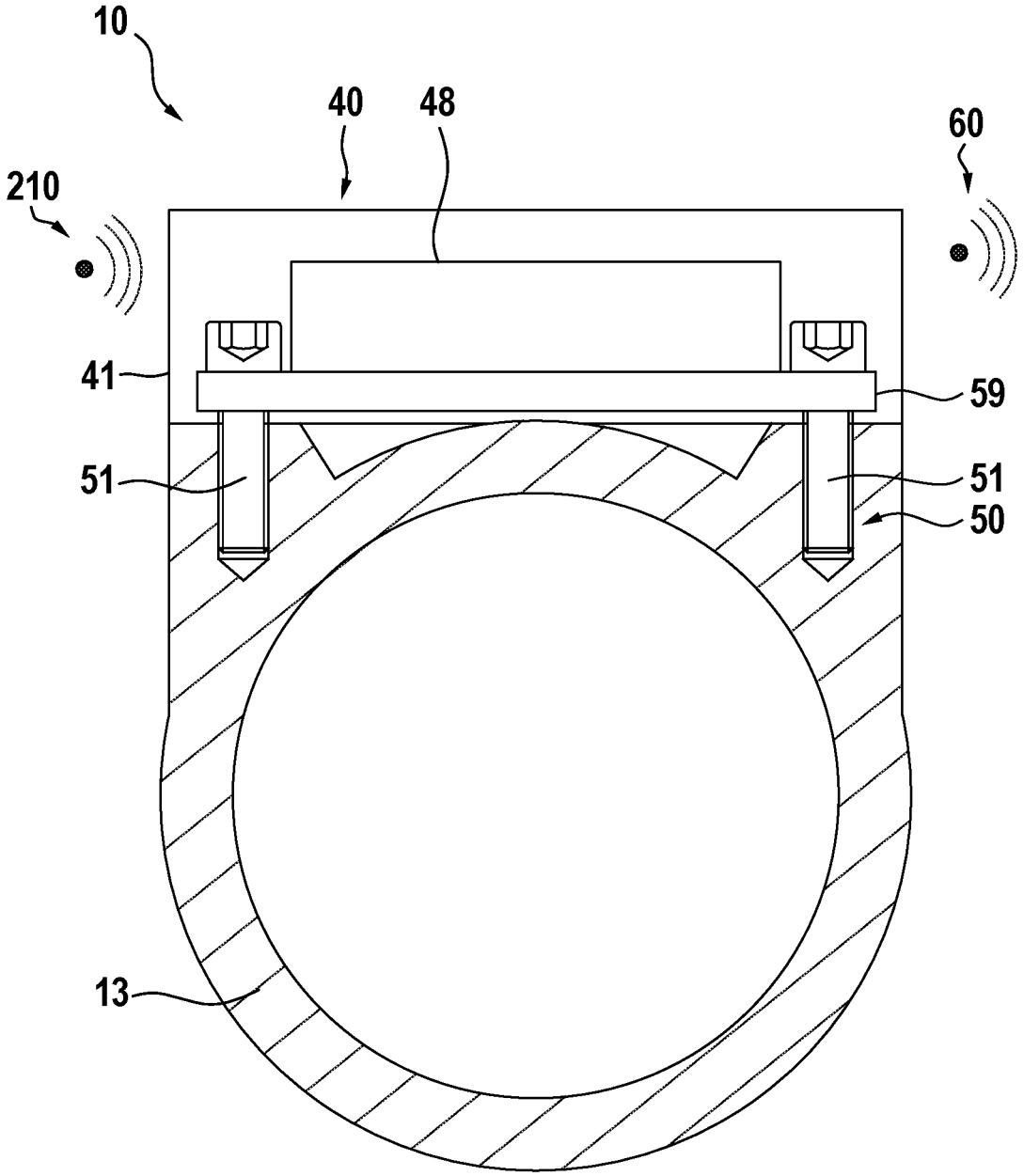
FIG. 3 a sectional view of the suction-extraction coupling adapter according to the disclosure.

FIG. 3 shows a sectional view of the suction-extraction coupling adapter 10. In particular, FIG. 3 shows a screwed connection 50, by means of screws 51, of the sensor device 40 to the suction-extraction coupling adapter 10. In addition, the communication unit 48 is also shown arranged on a printed circuit board 59.

FIG. 3 shows a schematic representation of the sensor device 40 as an enlarged detail. The sensor device 40 has a sensor-device energy supply unit 41, which supplies the sensor device 40 with energy. In this embodiment, the sensor-device energy supply unit 41 is supplied with energy by a battery, in particular at least one button cell. Alternatively, it would also be possible for energy to be supplied by an accumulator-battery unit, by means of energy harvesting.

In this embodiment of the disclosure, the at least one sensor device 40 has a sensor unit 46. The sensor unit 46 senses the operating signal 210 of the power tool 200, in particular of the hand-held power tool. In this embodiment, the sensor unit 46 is realized as an acceleration sensor that senses the operating signal 210 of the power tool 200, in particular its vibrations, during operation. The acceleration sensor senses substantially acceleration values of three spatial directions 90. However, other sensor units, considered appropriate by persons skilled in the art, are also conceivable. In this embodiment, the power tool 200, in particular the hand-held power tool, generates the operating signal 210 while it is in operation. The operating signal 210 in this case is the vibration, caused by a rotation of the power tool motor and/or by working on a workpiece. Owing to the connection of the power tool 200 to the suction-extraction coupling adapter 10, the sensor unit 46 can sense the operating signal 210.

As described at the beginning, the sensor device 40 additionally comprises the signal processing unit 47 and the communication unit 48. The sensor unit 46 transmits the sensed operating signal 210 to the signal processing unit 47. The signal processing unit 47 then processes the operating signal 210 into the communication signal 60, for example by means of at least one microprocessor and/or at least one microcontroller. The communication signal 60 comprises information relating to an operating state of the power tool 200, in particular of the hand-held power tool, such as, for example, switched on or switched off, or at least one pre-filtered signal, or other operating parameters considered appropriate by persons skilled in the art. In addition, the signal processing unit 47 transmits the communication signal 60 to the communication unit 48, in particular via a line.

The communication unit 48 is designed to receive the communication signal 60 from the signal processing unit 47. The communication unit 48 provides the communication connection 80 to the suction-appliance communication unit 130, and transmits the communication signal 60 to the suction-appliance communication unit 130, see also FIG. 2. In this embodiment, the communication connection 80 is effected wirelessly.

Figure 4:
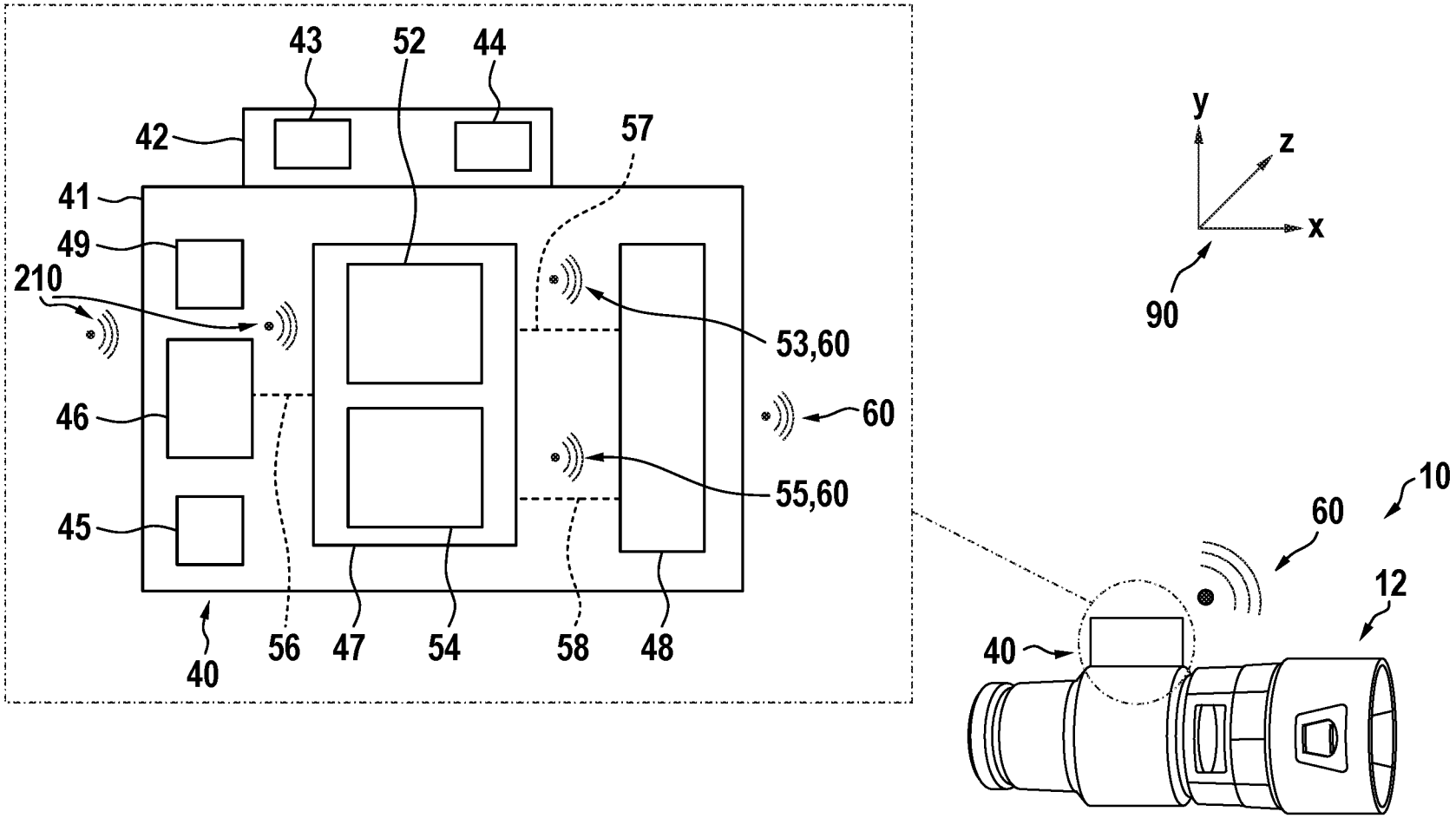
FIG. 4 the suction-extraction coupling adapter according to the disclosure with the sensor device, in an enlarged representation.

As shown by FIG. 4, the sensor device 40 comprises the sensor unit 46, the signal processing unit 47, the communication unit 48 and the sensor-device energy supply unit 45, these elements being arranged, in particular, within a sensor-device housing 41. The sensor unit 46 has a line connection 56 to the signal processing unit 47, such that the operating signal 210 is transmitted directly and immediately. The signal processing unit 47 processes the operating signal 210 into the communication signal 60. The signal processing unit 47 then sends the communication signal 60, by means of a line connection 57, 58, to the communication unit 48. The sensor device 40 also comprises an operator control unit 42. The operator control unit 42 additionally has an operator control element 43 and an indicating element 44. The operator control unit 42 enables the user to operate the sensor device 40, in particular to switch on and off. The operator control unit 42 of the sensor device 40 is also designed to provide and indicate to the user an operating state and/or an operating parameter and/or operating information of the sensor device 40 and/or the suction appliance 100. It would be possible in this case for the operator control unit 42 to indicate whether the sensor device 40 is switched on or switched off, whether the autostart function is activated, the charge state of the accumulator battery 122 of the suction appliance 100, or other information considered appropriate by persons skilled in the art. Alternatively, it is conceivable for the operator control unit 42 of the sensor device 40 to indicate the operating state of the power tool 200. The operator control unit 42 of the sensor device 40 is also designed to change operating states and/or operating parameters of the sensor device 40 and/or of the suction appliance 100, via the operator control element 43 and/or the indicating element 44, in particular to control the sensor device 40 and/or the suction appliance 100 by open-loop and/or closed-loop control. The operating states and/or operating parameters of the sensor device 40 are, for example, as described at the beginning. In this embodiment, the operator control unit 42 of the sensor device 40 is arranged on the sensor device housing 41. The sensor device 40 may additionally comprise an analog/digital converter unit 49 (A/D converter unit). By means of a suitable evaluation algorithm, the at least one A/D converter unit 49 converts an analog signal into a digital signal, as described at the beginning.

FIG. 4 shows a schematic representation of a first embodiment of the disclosure, as well as a schematic representation of a second embodiment of the disclosure. In the first embodiment of the disclosure, the signal processing unit 47 additionally has an evaluation unit 52. The evaluation unit 52 is provided to process the operating signal 210 into an evaluation signal 53. The evaluation unit 52 then transmits the evaluation signal 53, as the communication signal 60, to the communication unit 48 by means of a line connection 57. The communication unit 48 is designed to receive the evaluation signal 53 as a communication signal 60, and to send the communication signal 60, via the communication connection 80, to the suction-appliance communication unit 130. The suction-appliance communication unit 130 receives the communication signal 60 and forwards it by line to the suction-appliance control unit 121, see also FIG. 2. The suction-appliance control unit 121 receives the communication signal 60 and then controls the suction appliance 10 by open-loop and/or closed-loop control.

In the second embodiment of the disclosure, the signal processing unit 47 additionally comprises a filter unit 54, which is designed to convert the operating signal 210 into a filter signal 55. By means of a line connection 58, the filter unit 54 forwards the filter signal 55, as the communication signal 60, to the communication unit 48. The communication unit 48 sends the communication signal 60 wirelessly, via the communication connection 80, to the suction-appliance communication unit 130. The suction-appliance communication unit 130 receives the communication signal 60 and transmits it by line to the suction-appliance control unit 121. The suction-appliance control unit 121 evaluates the communication signal 60, in particular the filter signal 55, and controls the suction appliance 100 by open-loop and/or closed-loop control.

Figure 5:
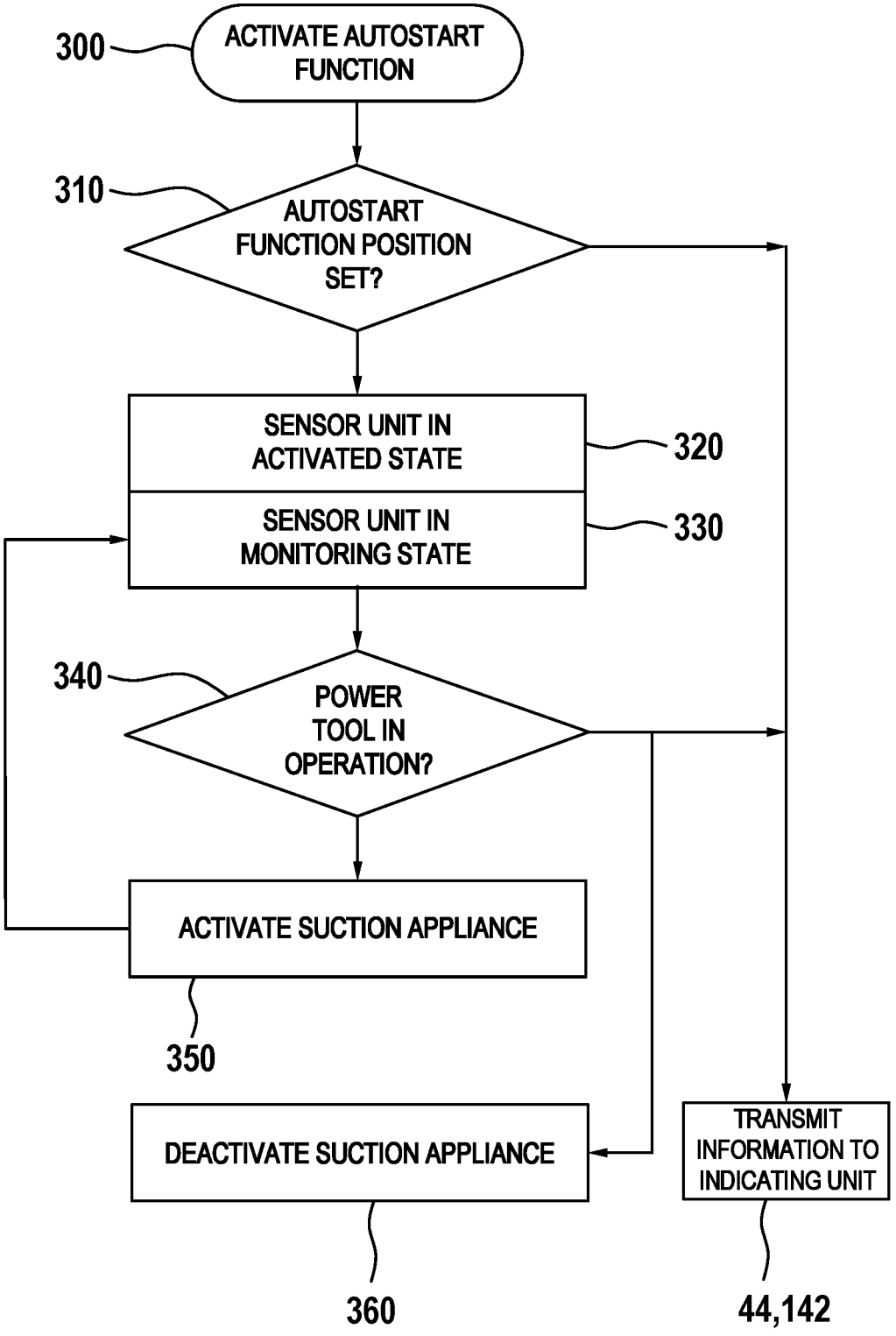
FIG. 5 a flow diagram to explain an autostart function.

FIG. 5 shows a flow diagram to explain the sensor device 40 and the autostart function. The user activates the autostart function 300, in that the user sets the suction-appliance operator control element 141 or the operator control element 43 of the sensor device 40 to an autostart function position 310. The sensor unit 46 of the sensor device 40 is thereby activated, and the sensor unit 46 is in an activated state 320. The control unit 46 begins to monitor the power tool 200, in particular the hand-held power tool, such that the operating signal 210 can be sensed. The sensor unit 46 in this case is then in a monitoring state 330. As soon as the power tool is in operation 340, the sensor unit 46 senses the operating signal 210, and the suction appliance 100 is started. The suction appliance 100 in this case is then in an activated state 350. While the suction appliance 100 is in the activated state 350, the sensor unit 46 remains in the monitoring state 330 and continues to sense the operation 340 of the power tool 200. As soon as the power tool 200 is no longer in operation 340, this change is sensed by the sensor unit 46, and the suction appliance 100 is deactivated 360. In this case a message to the user, concerning this change of state of the power tool 200, is then sent to the suction-appliance indicating element 142 and/or to the indicating element 44 of the sensor device 40.

If the suction-appliance operator control element 141 and the operator control element 43 of the sensor device 40 are not on the autostart function position 310, information is likewise transmitted to the suction-appliance indicating element 142 and to the indicating element 44 of the sensor device 40. This informs the user that the sensor device 40 is not yet activated and that the autostart function 300 is not available. In particular, the user is informed of the fact that the autostart function position 310 is not yet set.

The invention claimed is:

1. A suction-extraction coupling adapter for a suction appliance, comprising:

a machine coupling unit configured to separably connect the coupling adapter to a power tool;

a suction-appliance coupling unit configured to separably connect the coupling adapter to a suction hose of the suction appliance;

a sensor device comprising at least one sensor configured to detect at least one operating signal of the power tool that is indicative that the power tool is switched on; and a wireless transceiver configured to establish at least one wireless communication connection to the suction appliance, and to wirelessly transmit at least one communication signal to the suction appliance based on the detected at least one operating signal.

2. The suction-extraction coupling adapter as claimed in claim 1, wherein the sensor device further comprises a processor configured to receive the at least one operating signal from the at least one sensor unit and to generate the at least one communication signal based on the at least one operating signal.

3. The suction-extraction coupling adapter as claimed in claim 2, wherein the wireless transceiver is further configured to receive the at least one communication signal from the processor before wirelessly transmitting the at least one communication signal to the suction appliance.

4. The suction-extraction coupling adapter as claimed in claim 3, wherein the wireless transceiver provides the at least one communication connection to a suction appliance communication unit of the suction appliance.

5. The suction-extraction coupling adapter as claimed in claim 2, wherein the processor is further configured to:

generate at least one evaluation signal based on the at least one operating signal, and generate the at least one evaluation signal as the at least one communication signal.

6. The suction-extraction coupling adapter as claimed in claim 2, wherein the processor is further configured to:

filter the at least one operating signal to generate a filtered signal, and generate the filtered signal as the at least one communication signal.

7. The suction-extraction coupling adapter as claimed in claim 1, wherein:

the sensor device has at least one operator control unit, and the at least one operator control unit comprises at least one operator control element configured to be operated by a user and/or at least one indicating element configured to indicate to the user at least one operating state, at least one operating parameter, and/or at least one item of operating information of the sensor device and/or the suction appliance.

8. The suction-extraction coupling adapter as claimed in claim 1, wherein the sensor device is configured to control the suction appliance by open-loop and/or closed-loop control when the sensor device registers at least one predefined signal.

9. The suction-extraction coupling adapter as claimed in claim 1, wherein the power tool is a hand-held power tool.

10. The suction-extraction coupling adapter as claimed in claim 1, wherein the at least one sensor includes at least one acceleration sensor configured to sense vibrations of the power tool, at least one rotational speed sensor configured to sense at least one rotational speed of the power tool, at least one acoustic sensor configured to sense an operating sound of the power tool, at least one magnetic field sensor configured to detect at least one magnetic field of the power tool, at least one position sensor configured to detect a position of the power tool, and/or at least one movement sensor configured to sense at least one movement of the power tool.

11. The suction-extraction coupling adapter as claimed in claim 1, wherein the at least one sensor includes at least one acceleration sensor.

12. The suction-extraction coupling adapter as claimed in claim 11, wherein the at least one operating signal is based on vibrations sensed by the at least one acceleration sensor.

13. A system comprising:

a suction appliance; and a suction-extraction coupling adapter for the suction appliance, the suction-extraction coupling adapter comprising:

a machine coupling unit configured to separably connect the coupling adapter to a power tool;

a suction-appliance coupling unit configured to separably connect the coupling adapter to a suction hose of the suction appliance;

at least one sensor device comprising at least one sensor configured to detect at least one operating signal of the power tool that is indicative that the power tool is switched on; and a wireless transceiver configured to establish at least one wireless communication connection to the suction appliance and to wirelessly transmit at least one communication signal to the suction appliance based on the detected at least one operating signal.

14. The system as claimed in claim 13, further comprising the power tool, wherein the power tool is a hand-held power tool.

* * * * *